US010087955B2

(12) United States Patent
Burns

(10) Patent No.: US 10,087,955 B2
(45) **Date of Patent: *Oct. 2, 2018**

(54) AIRLIFT PUMP

(71) Applicant: Robert J. Burns, Baltimore, MD (US)

(72) Inventor: Robert J. Burns, Baltimore, MD (US)

( * ) Notice: Subject to any disclaimer, the term of this patent is extended or adjusted under 35 U.S.C. 154(b) by 3 days.

This patent is subject to a terminal disclaimer.

(21) Appl. No.: 15/623,449

(22) Filed: Jun. 15, 2017

(65) Prior Publication Data

US 2017/0284423 A1 Oct. 5, 2017

Related U.S. Application Data

(63) Continuation of application No. 14/642,705, filed on Mar. 9, 2015, now Pat. No. 9,709,074, which is a continuation of application No. 12/228,954, filed on Aug. 18, 2008.

(60) Provisional application No. 61/021,616, filed on Jan. 16, 2008, provisional application No. 60/979,403, filed on Oct. 12, 2007, provisional application No. 60/979,404, filed on Oct. 12, 2007, provisional application No. 60/956,134, filed on Aug. 16, 2007.

(51) Int. Cl.
*F04F 1/18* (2006.01)

(52) U.S. Cl.
CPC ..... *F04F 1/18* (2013.01)

(58) Field of Classification Search
CPC ..... F04F 1/00; F04F 1/02; F04F 1/18; F04F 5/24; F04B 47/04
See application file for complete search history.

(56) References Cited

U.S. PATENT DOCUMENTS

| | | | |
|---|---|---|---|
| 404,397 | A | 6/1889 | Geiser |
| 555,785 | A | 3/1896 | Misic |
| 559,810 | A | 5/1896 | Rand |
| 627,250 | A | 6/1899 | Cavallaro |
| 1,036,524 | A | 8/1912 | Miller |
| 1,214,952 | A | 2/1917 | Pruitt |
| 1,305,487 | A | 6/1919 | Owen |
| 1,333,279 | A | 3/1920 | Rigling |
| 1,334,638 | A | 3/1920 | Tucker |
| 1,426,863 | A | 8/1922 | Halvorsen |
| 1,603,604 | A | 10/1926 | Hunter |
| 1,717,448 | A | 6/1929 | Halvorsen |
| 1,740,807 | A | 12/1929 | Clifford |
| 1,741,571 | A | 12/1929 | Ives |
| 1,771,377 | A | 7/1930 | Halvorsen |
| 2,359,717 | A | 10/1944 | Myers |
| 2,418,788 | A | 4/1947 | Nixon |

(Continued)

*Primary Examiner* — Peter J Bertheaud
*Assistant Examiner* — Dnyanesh Kasture
(74) *Attorney, Agent, or Firm* — Joseph P. Kincart; Rogers Towers, P.A.

(57) ABSTRACT

An airlift pump comprising a hollow, cylindrical main body having an injection hole near the bottom end, a channel routed in the outside surface of the main body and extending continuously from the injection hole to the top end, and an air tube seated in the channel and bonded to the main body. The air tube comprises an injection end having an elbow forming an injection angle such that the air is injection into the main body in a downward direction toward the bottom end. The air tube further comprises a receiving end extending past the top end of the main body and connecting to air supply tubing. The pump has a restricted lateral width enabling the pump to fit inside the narrow monitoring wells typical in the groundwater monitoring industry.

7 Claims, 6 Drawing Sheets

(56) References Cited

U.S. PATENT DOCUMENTS

| | | | |
|---|---|---|---|
| 2,744,065 | A | 5/1956 | Lacey |
| 2,845,940 | A | 8/1958 | Garrett et al. |
| 3,050,121 | A | 8/1962 | Garrett et al. |
| 3,120,869 | A | 2/1964 | Carpenter |
| 3,444,821 | A | 5/1969 | Wolsh |
| 3,585,709 | A | 6/1971 | Muller et al. |
| 3,672,790 | A | 6/1972 | White et al. |
| 4,271,916 | A | 6/1981 | Williams |
| 4,756,671 | A | 7/1988 | Grimes et al. |
| 5,018,575 | A | 5/1991 | Parsons |
| 5,033,550 | A | 7/1991 | Johnson et al. |
| 5,067,060 | A | 11/1991 | Sieracki |
| 5,154,570 | A | 10/1992 | Yoshikawa et al. |
| 5,771,965 | A | 6/1998 | Inaba et al. |
| 6,132,195 | A | 10/2000 | Ikoma et al. |
| 6,409,488 | B1 | 6/2002 | Ikoma et al. |
| 7,311,144 | B2 | 12/2007 | Conrad |
| 7,316,544 | B2 | 1/2008 | Vidrine |
| 7,437,988 | B2 | 10/2008 | Andersson et al. |
| 2002/0172600 | A1 | 11/2002 | Anderson |
| 2007/0007949 | A1 | 1/2007 | Andersson et al. |

AIRLIFT PUMP

CROSS-REFERENCE TO RELATED APPLICATION

This application is a continuation of Ser. No. 14/642,705, filed on Mar. 9, 2015, entitled "Airlift Pump" which was a continuation-in-part of U.S. patent application Ser. No. 12/228,954, filed Aug. 18, 2008, which claims the benefit of U.S. Provisional Patent Application Ser. No. 60/956,134 filed on Aug. 16, 2007; Ser. No. 60/979,403 filed on Oct. 12, 2007; Ser. No. 60/979,404 filed on Oct. 12, 2007; and Ser. No. 61/021,616 filed on Jan. 16, 2008, the entire contents of each of which are incorporated herein by this reference.

BACKGROUND (1) Field of Invention

The airlift pump device described herein relates generally to the recovery of subsurface liquid or semi-liquid material, and specifically to an airlift pump having a streamlined surface for repeated insertion into and removal from narrow groundwater monitoring wells without entanglement.

(2) Background

An airlift pump generally comprises a hollow, cylindrical main body connected to a drainage conduit. The main body is submerged into a subsurface liquid or semi-liquid material, causing the interior of the main body to fill with such material. A gas, such as air, is then introduced into the main body, thereby reducing the specific gravity of the material in the upper part of the main body, which causes that material to become buoyant. As the buoyant material moves upward toward the ground surface, additional liquid material is drawn into the bottom end of the main body, causing a continuous pumping action.

The present device comprises an improved airlift pump for use in the groundwater monitoring industry. This industry uses standard monitoring wells having a relatively small diameter, and prior airlift pumps were difficult, if not impossible, to operate in such tight confines. In addition, operation of prior airlift pumps required expensive customized equipment because these pumps could not accommodate the hoses, fittings, and other pumping equipment standard in the industry.

The device disclosed herein seeks to overcome these problems by providing an improved airlift pump comprising features that optimize performance in the confines of narrow wells. The simplified features and operation of the device permit a significant cost savings over the current pumping methods.

SUMMARY

The airlift pump device generally comprises a hollow, cylindrical main body having an open top end and an open bottom end, and an air tube. The main body has a connection means near the top end. The connection means forms a substantially watertight connection between the main body and discharge tube. An injection hole is located near the bottom end at a distance that can range approximately from one to two and one half inches from the edge of the bottom end. The outside of the main body further comprises a routed channel or elongated recess for seating and retaining the air tube, and the channel runs continuously along the outside of the main body to the top end.

The air tube is a metal tube having a receiving end and an injection end, with the injection end further comprising an elbow forming an injection angle such that the air is injected into the main body in a downward direction toward the bottom end rather than in an upward direction toward the top end. The injection end of the air tube is inserted into the injection hole, and the air tube is seated inside and along the channel in a manner such that the receiving end of the air tube extends past the top end of the main body. The air tube is then secured to the main body by a bonding means, which is any means for securing the air tube to the main body using non-contaminating materials that provide a streamlined shape, such as an adhesive, an epoxy, or a weld.

In use, standard air supply tubing is attached to the receiving end of the air tube, and standard discharge tube is attached to the connection means of the main body. When air is introduced into the air tube via the air supply tubing, the air travels down the air tube, past the elbow, and into the interior portion of the main body at a downward angle. The injected air reduces the specific gravity of the material inside the main body above the injection hole, thus causing this column of material to become buoyant and move upward toward the discharge tube. As this column of material moves, additional material is drawn into the main body via the bottom end, and this continuous action drives the pump.

In another embodiment of the pump, the main body is comprised of a thin-walled metal tube that does not comprise a channel. Instead, the air tube is bonded directly to the outside surface of the main body, with the other features remaining the same. In another embodiment, the connection means comprises a thread insert to accommodate a standard fitting. In another embodiment, the receiving end of the air tube comprises a slight bend forming a deviation angle to accommodate the standard fittings.

DETAILED DESCRIPTION OF THE PREFERRED EMBODIMENTS

With reference to the drawings, the improved airlift pump will now be described with regard for the best mode and the preferred embodiment. In general, the device is an airlift pump, specifically modified and improved for use in the groundwater sampling industry. The pump is improved for repeated insertion into and removal from the narrow confines of standard well sizes using equipment standard in the industry, and it is fabricated from materials that will not contaminate the groundwater sample. Notably, the improved pump will work with a variety of subsurface liquids or semi-liquids, including water, oil, liquid contaminants, or substantially aqueous mud, silt, and sand. Although the following discussion illustrates the pump in the context of groundwater sampling, the embodiments disclosed herein are meant for illustration and not limitation of the invention. An ordinary practitioner will appreciate that it is possible to create variations of the following embodiments without undue experimentation.

Figure 1:
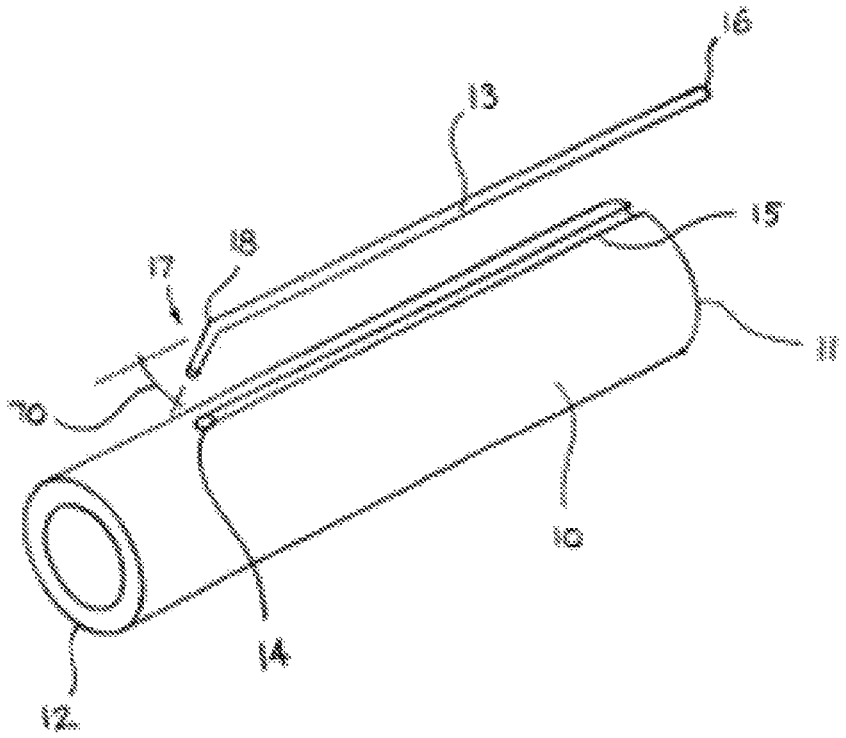
FIG. 1 is an oblique view of the air tube and main body, showing the air tube as separated from the main body.
Figure 2:
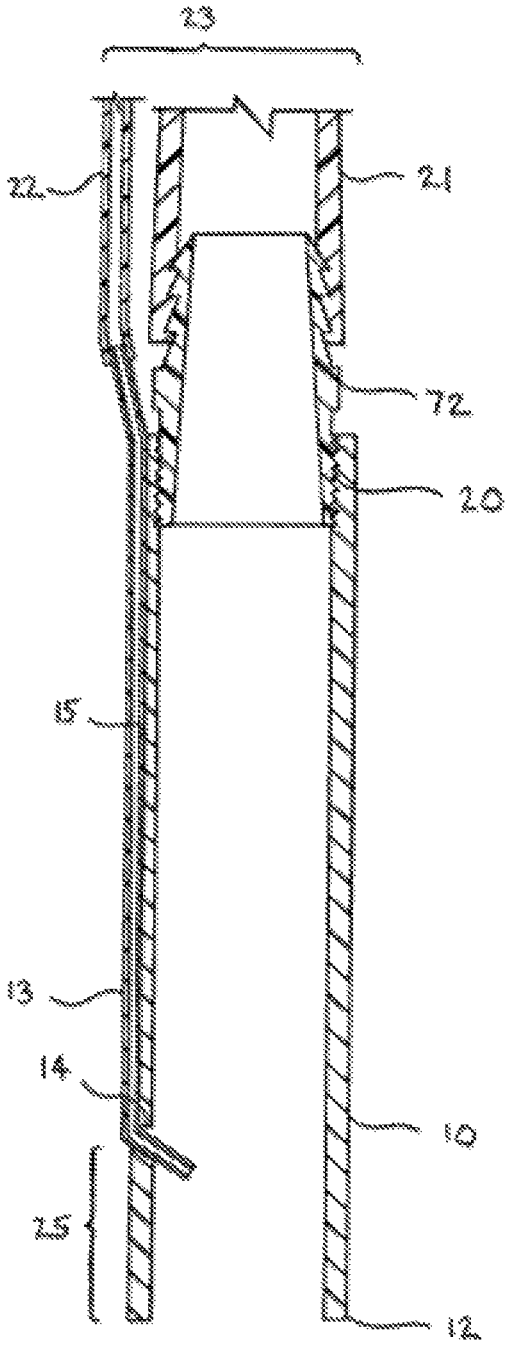
FIG. 2 is a cross section of the improved airlift pump having air supply tubing attached to the receiving end of the air tube and discharge tube attached by a fitting.

Referring to FIGS. 1 and 2, the device generally comprises a hollow, cylindrical main body 10 having a wall, an open top end 11 and an open bottom end 12, and an air tube 13. The main body 10, which can be a standard metal pipe, is preferably made of a non-corrosive material that will not contaminate the groundwater sample. Near the top end 11, the main body 10 has a connection means 20 for joining the main body 10 to a discharge tube 21. The connection means 20 forms a substantially watertight connection between the main body 10 and discharge tube 21 through which water, sand, and light gravel exit the main body 10 and are retrieved to the ground surface. An injection hole 14, which is a bore penetrating the wall of the main body 10, is located near the bottom end 12 at a distance 25 that can range approximately from one to two and one half inches from the edge of the bottom end 12. The injection hole 14 is sized for receiving the air tube 13, as described below. The main body 10 preferably comprises a routed channel 15 for seating and retaining the air tube 13. The channel 15 begins at the injection hole 14 and runs continuously along the main body 10 to the top end 11.

The air tube 13 is a thin-walled tube preferably composed of metal, such as stainless steel for example. The air tube 13 has a receiving end 16 and an injection end 17, with the injection end 17 further comprising an elbow 18 having an injection angle 70 such that the air is injected into the main body 10 in a downward direction toward the bottom end 12 (as shown in FIG. 2) rather than in an upward direction toward the top end 11. In most instances, the injection angle 70 will be within the range of approximately 30 to 70 degrees off of the longitudinal axis of the air tube 13, as shown in FIG. 1. It is preferable that the injection angle 70 lies within the range of about 35 to 55 degrees. The injection angle 70 permits the air tube 13 to be cleaned by inserting a wire into the receiving end 16 and forcing the wire through the air tube 13 until it emerges from the injection end 17. If the injection angle 70 is more than 70 degrees, then any debris or blockage inside the air tube 13 is unlikely to be removed in this manner, instead becoming impacted inside the air tube 13. If the injection angle 70 is less than 30 degrees, then the performance of the pump is reduced to a suboptimal level.

The injection end 17 is inserted into and through the injection hole 14, and the air tube is seated inside and along the channel 15 in a manner such that the receiving end 16 of the air tube 13 extends past the top end 11 of the main body 10, and such that the injection end 17 extends into the interior of the main body 10. This extension permits the air to be introduced into the main body 10 at a location closer to its central axis, thus enabling a more uniform dispersion of air, which may lead to a more optimal performance.

After the air tube 13 is seated in the channel 15, the air tube 13 is then secured to the main body 10 by any means for securing the air tube 13 to the main body 10 in a manner providing a streamlined shape, preferably by a bonding means 19. For example, a tungsten inert gas (TIG) weld serves as an adequate bonding means 19 because this weld is well suited for thin-walled metal tubing, such as that used for the air tube 13, especially where the metal tubing is stainless steel. In addition, a TIG weld does not use silver acetate material, which can contaminate groundwater samples. A continuous bonding means 19, such as a full length continuous weld, is preferable because it provides a streamlined shape, thus reducing the propensity for the pump to become entangled or snagged inside the tight-fitting monitoring wells typical in the industry. Although a spot weld can result in irregularities potentially causing entanglements inside the monitoring well, in some instances a streamlined spot weld can constitute an adequate bonding means 19, specifically where the well diameter is relatively large compared to the lateral width 23 of the pump. The lateral width 23 is the widest lateral dimension of the overall pump measured perpendicular to the longitudinal axis of the main body 10. Thus, the lateral width 23 is the diameter of the main body 10 plus the greatest distance that the air tube 13 laterally protrudes from the outside surface of the main body 10.

In use, standard air supply tubing 22 is attached to the receiving end 16 of the air tube 13, and a standard discharge tube 21 is attached to the main body 10. The pump is then inserted into a monitoring well to the desired depth, with the bottom end 12 below the water surface. An air compressor at the ground surface forces air through the air supply tubing 22 and into the air tube 13. The air travels down the air tube 13, past the elbow 18, and into the interior portion of the main body 10 in a downward direction at the injection angle 70. The injected air reduces the specific gravity of the material inside the main body 10 above the injection hole 14, thus causing this column of material to become buoyant and move upward toward the discharge tube 21. As this column of material moves, additional material is drawn into the main body 10 via the bottom end 12, and this continuous action drives the pump.

Figure 3:
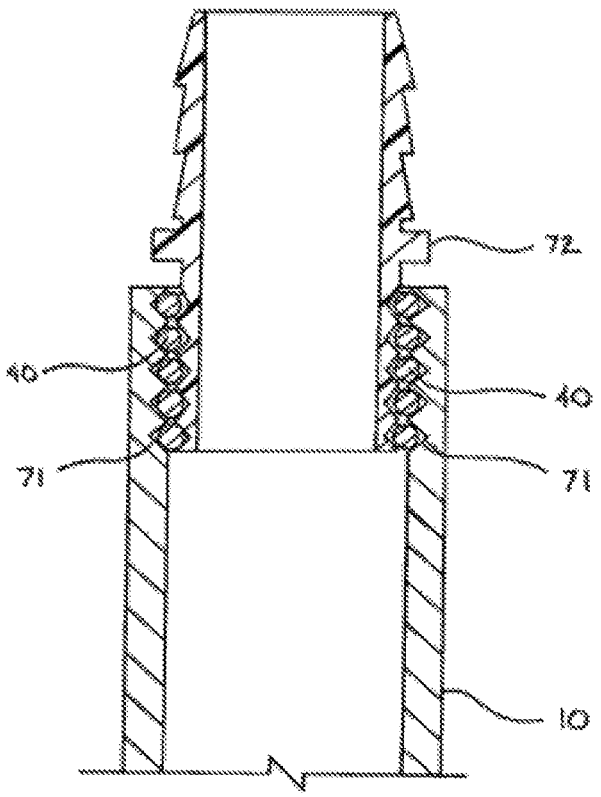
FIG. 3 is a cross section of the connection means, showing a standard fitting attached by a threaded insert.

Referring to FIGS. 1-3, one embodiment of the pump is intended for use inside a standard groundwater monitoring well having a diameter of about two inches. In this embodiment, the main body 10 is a metal pipe selected from a schedule of standard pipe sizes, and the lateral width 23 is two inches or less. The injection hole 14 may be located at a distance 25 of approximately one and one half inches from the bottom end 12, and the injection angle 70 of the elbow 18 may be approximately 45 degrees. The air tube 13 is seated in the channel as described above, and the bonding means 19 is a continuous TIG weld. The injection end 17 of the air tube 13 protrudes into the interior portion of the main body 10. The connection means 20 comprises female threads 71 integral to the inside surface of the main body 10 near the top end 11. The discharge tube 21 uses a standard fitting 72 having male threads mating to the female threads 71 (FIG. 2), thus forming a substantially watertight connection. For example, one such fitting 72 is a hose barb to male thread pipe fitting. In another emulation of this embodiment, the receiving end 16 of the air tube 13 embodies a deviation angle 73 falling within the range of approximately 5 to 30 degrees. The deviation angle 73, shown in FIG. 4, allows space for the discharge tube 21 and air supply tubing 22 to be secured in the proximity of the fitting 72.

In another variation of this embodiment, shown in FIG. 3, the standard pipe selected as the main body 10 can have an inside diameter substantially larger than the diameter of the male threads on the standard fitting 72. In these instances, a coiled wire thread insert 40 is used to reduce the inside diameter of the main body 10, thus providing properly sized female threads 71 to mate with the male threads of the standard fitting 72. By way of example, one such thread insert 40 is the Heli-Coil® thread insert, which is available from Newfrey, LLC.

In another embodiment, the pump is intended for use inside a standard groundwater monitoring well having a diameter of about one inch or more. In this embodiment, the main body 10 is a metal pipe selected from a schedule of standard pipe sizes. The injection hole 14 may be located at a distance 25 of approximately one and one half inches from the bottom end 12, and the injection angle 70 of the elbow 18 may be approximately 45 degrees. The air tube 13 is seated in the channel as described above, and the bonding means 19 is a continuous TIG weld. The lateral width 23 is less than one inch. The connection means 20 comprises female threads 71 integral to the inside surface of the main body 10 near the top end 11. Preferably the female threads 71 are self-tapping. The discharge tube 21 uses a standard fitting 72 having male threads that mate with the female threads 71, and a thread insert 40 can be used where required, as described above.

Figure 4:
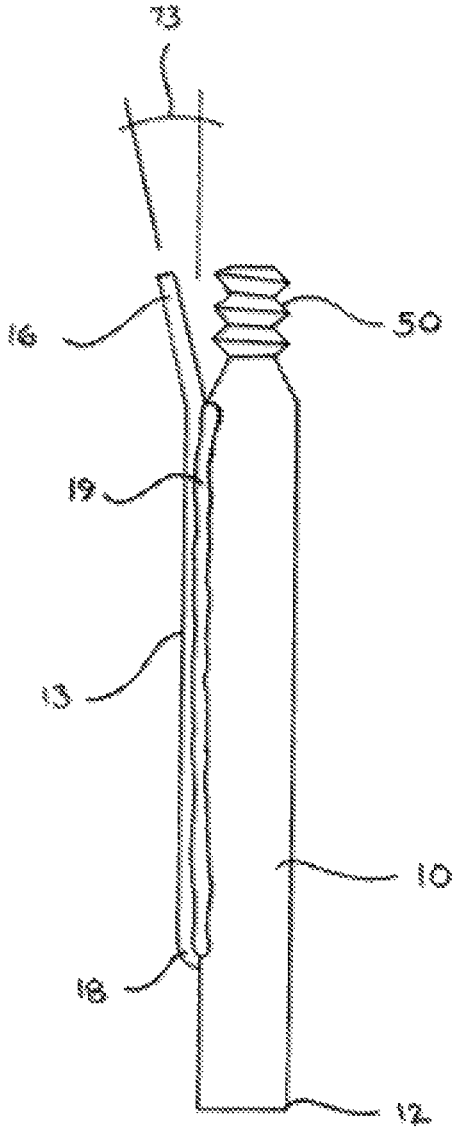
FIG. 4 is a side view of an embodiment where the air tube is attached to the outside surface of the main body by a continuous weld.
Figure 5:
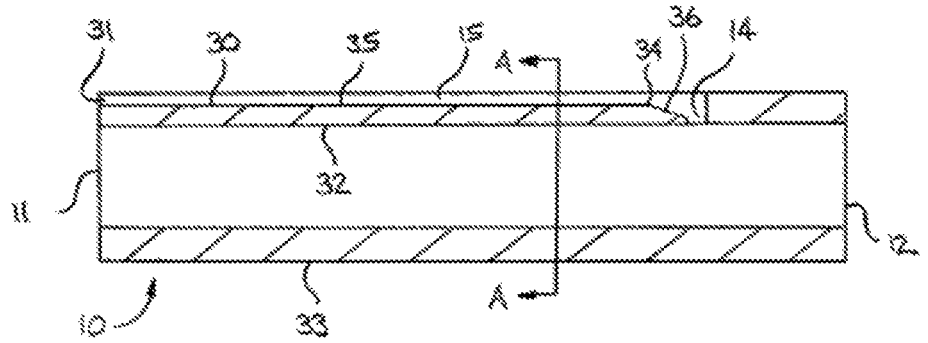
FIG. 5 is a cross section of one embodiment of the main body having a channel with a first mill and a second mill.
Figure 6:
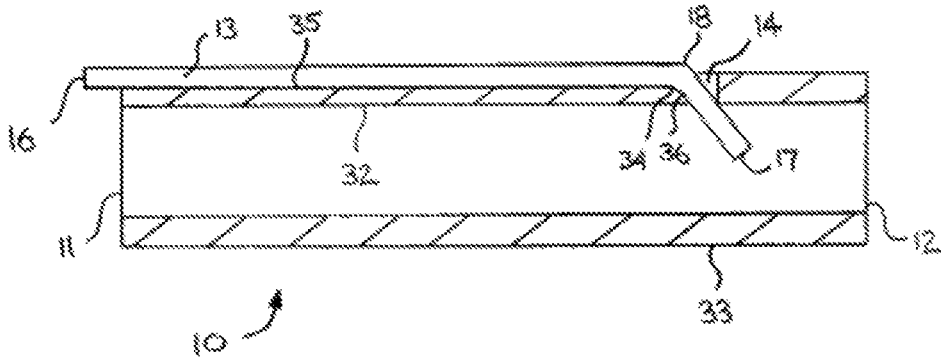
FIG. 6 is a cross section of one embodiment of the main body having a first mill and a second mill, and showing an air tube seated in the channel.

In another embodiment, shown in FIG. 4, the pump is intended for use inside a standard groundwater monitoring well having a diameter of three quarters of one inch or more. In this embodiment, the main body 10 is a metal pipe selected from a schedule of standard pipe sizes, which embody thin-walled sections. The injection hole 14 may be located at a distance 25 of approximately one and one half inches from the bottom end 12, and the injection angle 70 of the elbow 18 may be approximately 45 degrees. In this embodiment, since the main body 10 is a thin-walled section, there is no channel 15. Instead, the air tube 13 is bonded directly to the outside surface of the main body 10, and the bonding means 19 may be a continuous TIG weld. The lateral width 23 is less than three quarters of one inch. The connection means 20 comprises male threads 50 integral to the outside surface of the main body 10 near the top end 11. These male threads 50 provide a substantially watertight connection to standard fittings 72 for the discharge tube 21. Preferably, the male threads 50 are self-tapping. In this embodiment, the receiving end 16 of the air tube 13 embodies a deviation angle 73 falling within the range of about 5 degrees to about 30 degrees. The deviation angle 73 allows space for the discharge tube 21 and air supply tubing 22 to be secured in the proximity of the fitting 72.

Figure 7:
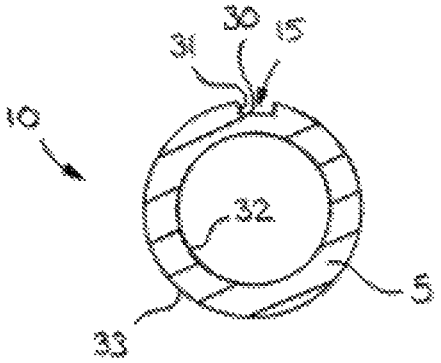
FIG. 7 shows section A-A of one embodiment of the main body having a square or substantially square channel.
Figure 8:
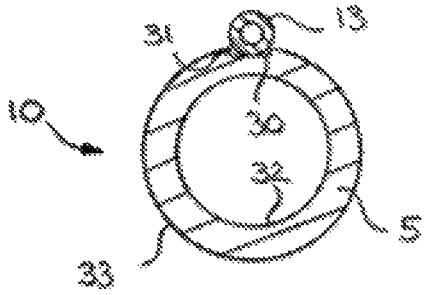
FIG. 8 shows section A-A of one embodiment of the main body having a square or substantially square, shallow channel with an air tube seated high in the channel.
Figure 9:
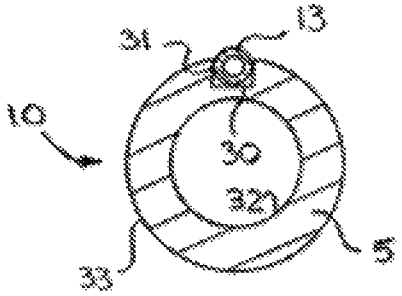
FIG. 9 shows section A-A of one embodiment of the main body having a square or substantially square, deep channel with an air tube seated low in the channel.

In another embodiment, shown in FIGS. 5-9, the channel comprises a base 30 and two sidewalls 31 disposed in a square or substantially square orientation. That is, the sidewalls 31 are disposed at a right angle or a substantially right angle relative to the base 30. This orientation shown more particularly in FIGS. 7-9, is advantageous for seating the air supply tube 22 into the channel 15 and bonding the air tube 13 to the body 10. The substantially square orientation of the base 30 and sidewalls 31 assist in the bonding process by enabling welding or soldering flux to flow properly around the air tube 13 to make an adequate bond.

Referring again to FIGS. 5 and 6, the body 10 has an inside surface 32 and an outside surface 33. The channel 15 begins at the injection hole 14 and extends continuously to the top end 11. The channel 15 is milled into the wall 5 of the body 10 such that formation of the channel 15 does not displace or deform the inside surface 32 of the body 10. In other words, formation of the channel 15 does not cause the inside surface to bulge or protrude into the hollow cavity of the body 10. Instead, the channel 15 is formed by milling, routing, or grinding the outer surface of the body 10 to remove material from the wall 5.

The channel 15 has a break point 34 located proximate to the injection hole 14, a first mill 35 beginning at the break point 34 and extending continuously to the top end 11. The first mill 35 has a base 30 oriented parallel or substantially parallel to the inside surface 32 of the body 10 so that the thickness of the wall 5 along the length of the first mill 35 is constant or substantially constant. The channel 15 has a second mill 36 beginning at the break point 34 and extending to the injection hole 14, the second mill 36 having a base 30 oriented at taper with respect to the inside surface 32 of the main body 10 such that the wall 5 of the body 10 is thinner at the second mill 36 than it is at the first mill 35. The thickness of the wall 5 varies along the length of the second mill 36, being thickest in proximity to the break point 34 and thinnest in proximity to the injection hole 14.

In this embodiment, the air tube 13 is seated in the channel 15 such that the elbow 18 coincides with the break point 34 so that the air tube 13 from the receiving end 16 to the elbow 18 is seated along the first mill 35 and the air tube 13 from the elbow toward the injection end 17 is seated along the second mill 36.

The depth of the channel 15 affects the degree to which the airlift pump is streamlined. For example, referring to FIG. 8, when the sidewalls 31, and therefore the channel 15, are relatively shallow, the air tube 13 sits higher in the channel 15. In this embodiment, the air tube 13 penetrates or protrudes into the wall 5 of the body 10 by a distance of less than half of the diameter of the air tube 13, as shown in FIG. 8. By contrast, referring to FIG. 9, when the sidewalls 31, and therefore the channel 15 are deeper, the air tube 13 sits lower in the channel 15. This enables the airlift pump to have a lower profile and more streamlined section. In the embodiment shown in FIG. 9, the air tube 13 penetrates or protrudes into the wall 5 of the body 10 by a distance of more than half of the diameter of the air tube 13. In either of the foregoing arrangements, the depth of the channel 15, and therefore the depth of the air tube 13 seating, is consistent along the length of the channel 15 from the break point 34 to the top end 11.

In one embodiment of a bonding means 19, the bonding means 19 is a weld or solder applied to the interface between the air tube 13 and the main body 10 along the channel 15. Applying high levels of heat to thin-walled tubes, and especially the air tubes 13, can cause the tubes to warp. To prevent such warping, the weld or other bonding means 19 is applied in connection with a heat sink to dissipate high levels of localized heat.

The embodiments disclosed above are merely representative of the pump and not meant for limitation of the invention. For example, one having ordinary skill in the art would understand that some of the individual features of several disclosed embodiments are interchangeable with the features of other embodiments. Consequently, it is understood that equivalents and substitutions for certain elements and components set forth above are part of the invention, and therefore the true scope and definition of the invention is to be as set forth in the following claims.

What is claimed is:

1. A improved method of operating an air lift pump for repeated subterranean insertion into and removal from sampling wells useful in groundwater monitoring, the airlift pump comprising:

inserting an airlift pump with a bottom end into a monitoring well with the bottom end below a water surface in the monitoring well, the pump comprising a hollow, cylindrical main body having a top end, a bottom end, and a cylindrical wall between the top end and bottom end, the cylindrical wall having an inside surface and an outside surface, and an injection hole bored through a wall of the cylindrical main body near said bottom end, and a channel beginning at the injection hole and extending continuously along an outside surface of the main body to said top end, the channel milled into the wall of the main body such that no portion of the channel displaces the inside surface of the main body, the channel having:

(a) a base and two sidewalls, the base and sidewalls disposed at a substantially square orientation;

(b) a break point located proximate to the injection hole;

(c) a first mill beginning at the break point and extending continuously to the top end, the first mill having a base oriented substantially parallel to the inside surface of the body; and (d) a second mill beginning at the break point and extending to the injection hole, the second mill having a base oriented at taper with respect to the inside surface of the main body such that the wall of the body is thinner at the second mill than it is at the first mill;

seating an air tube in the channel;

connecting the air tube to the main body via a bond between the air tube and the main body along a length of the channel forming a streamlined section to the body of the air lift pump beginning at the injection hole and extending along the length of the body to the top end of the main body;

forcing air into an air tube having a receiving end and an injection end; said injection end in fluid communication with the injection hole;

injecting air into an interior portion of the main body at an angle based upon an injection angle formed by a bend in the air tube;

causing a column of material in the interior portion of the main body to become buoyant with the air injected into the interior portion of the main body;

move the column of material upward towards a discharge tube; and discharging the column of material from the discharge tube.

2. The improved method of operating an air lift pump of claim 1 additionally comprising the step of drawing additional material into the main body via the bottom end as the column of material is discharged from the discharge tube.

3. The improved method of operating an air lift pump of claim 1, wherein said bond of the air tube to the main body comprises a continuous weld.

4. The improved method of operating an air lift pump of claim 3, wherein a lateral width of the cylindrical main body is two inches or less.

5. The improved method of operating an air lift pump of claim 4, wherein the injection hole is located at a distance from the bottom end within a range of one inch to two and one half inches.

6. A method of operating an improved air lift pump, the method comprising the steps of:

inserting the improved air lift pump into a first well, the pump comprising a hollow, cylindrical main body having an outer surface, an inner surface, a top end, a bottom end, and a cylindrical wall between the top end and bottom end, and an injection hole bored through the wall of the cylindrical main body near the bottom end, and a channel beginning at the injection hole and extending continuously along the outside surface of the main body to said top end, the channel milled into the wall of the body such that no part of the channel displaces the inside surface of the body, the channel having:

(a) a base and two sidewalls, the base and two sidewalls disposed at a substantially square orientation;

(b) a break point located proximate to the injection hole;

(c) a first mill beginning at the break point and extending continuously to the top end, the first mill having a base oriented substantially parallel to the inside surface of the body; and (d) a second mill beginning at the break point and extending to the injection hole, the second mill having a base oriented at taper with respect to the inside surface of the main body such that wall of the body is thinner at the second mill than it is at the first mill;

operating the improved air lift pump via insertion of air into an air tube having a receiving end and an injection end, the injection end having an elbow forming an injection angle such that an injection end of the air tube points downward toward said bottom end, said injection end inserted into and through the injection hole such that the injection end protrudes beyond the cylindrical wall and into an interior of the main body, said air tube seated in the channel and connected to the main body bonding the air tube to the main body, wherein the air tube protrudes laterally into the wall of the body at a distance that is less than half of a diameter of the air tube;

removing the improved air lift pump from the first well;

inserting the improved air lift pump into a second well; and operating the improved air lift pump in the second well.

7. The method of operating an improved air lift pump of claim 6, additionally comprising the step of locating the injection hole at a distance from said bottom end such that air injected into the main body does not exit said bottom end.

* * * * *